US009585534B2

(12) United States Patent
Reccanello

(10) Patent No.: US 9,585,534 B2
(45) Date of Patent: Mar. 7, 2017

(54) CLEANING MACHINE FOR CLEANING SURFACES

(71) Applicant: IP CLEANING S.P.A., Portogruaro (VE) (IT)

(72) Inventor: Francesco Reccanello, Padua (IT)

(73) Assignee: IP CLEANING S.P.A., Portogruaro (VE) (IT)

( * ) Notice: Subject to any disclaimer, the term of this patent is extended or adjusted under 35 U.S.C. 154(b) by 4 days.

(21) Appl. No.: 14/688,039

(22) Filed: Apr. 16, 2015

(65) Prior Publication Data

US 2015/0297051 A1 Oct. 22, 2015

(30) Foreign Application Priority Data

Apr. 17, 2014 (IT) ..... RE2014A0038

(51) Int. Cl.
*A47L 11/40* (2006.01)
*A47L 11/24* (2006.01)
*A47L 11/282* (2006.01)

(52) U.S. Cl.
CPC ..... *A47L 11/24* (2013.01); *A47L 11/282* (2013.01); *A47L 11/4055* (2013.01); *A47L 11/4072* (2013.01); *A47L 11/4058* (2013.01)

(58) Field of Classification Search
CPC ..... A47L 11/4052; A47L 11/4055; A47L 11/4058; A47L 11/4072; A47L 11/14
USPC ..... 15/49.1, 50.1
See application file for complete search history.

(56) References Cited

U.S. PATENT DOCUMENTS 3,346,896 A 10/1967 Arones
4,586,211 A 5/1986 Phillips
5,177,828 A 1/1993 Von Vett
6,618,888 B2 * 9/2003 Joynt ..... A47L 11/16 15/320

OTHER PUBLICATIONS

European Extended Search Report dated Jul. 21, 2015. In corresponding application No. EP15162587.

* cited by examiner

*Primary Examiner* — Laura C Guidotti
(74) *Attorney, Agent, or Firm* — Browdy and Neimark, PLLC

(57) ABSTRACT

A cleaning machine for cleaning surfaces, including a support frame holding a rotary cleaning organ to clean the desired surface, first rest for the support frame, auxiliary rest wheel of the support frame movable into assume first and second positions in which it is raised and lowered, respectively, the auxiliary wheel being positioned at a base of a stem slidable in a bushing associated to the support frame with the axis perpendicular to the support frame between a first raised position and a second lowered position. The stem includes a groove defined on a surface thereof and the bushing includes a pin projecting internally thereof and able to slide in the groove. The groove includes first and second upper cusps proximal to the end of the stem that is distal from the wheel, the first and second upper cusps being alternated with first and second lower cusps directed towards the end of the stem proximal to the wheel.

3 Claims, 3 Drawing Sheets

CLEANING MACHINE FOR CLEANING SURFACES

TECHNICAL FIELD

The present invention relates to a cleaning machine for cleaning surfaces.

In particular, the invention relates to a cleaning machine for cleaning surfaces, such as floors, that can be moved on the surface.

PRIOR ART

As is known, many cleaning machines for surfaces such as floors exist, in particular for cleaning large-dimension surfaces such as, for example, floors of shops, shopping malls, stores, industrial warehouses, airports.

The known cleaning machines usually comprise a main frame that is mobile on the floor to be cleaned by means of wheels.

In general the frame comprises at least a pair of fixed-axis wheels, flanked to one another and fixed at a back end of the frame.

The frame comprises a maneuvering handle or handlebar able to be pushed so as to guide the machine in the desired direction.

The cleaning machines can be activated in movement by a motor, for example electric, or pushed manually by the operator.

The cleaning means further comprise at least a rotary cleaning organ, for example a brush, associated to the frame and able to enter into contact with the surface to be cleaned.

The rotary organ is activated in rotation by a motor, for example electric, supported by the support frame.

In this way, when rotating the brush rubs on the floor to be cleaned, exerting a cleaning action.

In some cases the cleaning action is exerted with the use of water mixed with appropriate detergents.

The support frame therefore rests on the ground frontally by means of the rotary organ, and posteriorly by means of the wheels.

During transfer of the machine, the rotary organ must be raised from the ground, and this is done by oscillating the frame rested on the wheels upwards, using the handlebar.

In this way the front part of the frame is raised and inclined, and with it the cleaning organ which becomes positioned at a distance from the ground.

The transfer of the machine is therefore facilitated, but the frame must be kept manually inclined and the cleaning organ raised.

The aim of the present invention is to disclose a cleaning machine of the above-defined type, which during the transfer can be provided with a front wheel for resting the frame, able to be located in a lowered position with respect to the frame in which it maintains the frame inclined and the cleaning organ raised from the floor level, and in a raised position close to the frame, in which the wheel is raised from the floor surface and the frame rests on the floor by means of the cleaning organ.

Known examples of cleaning machines for cleaning surfaces are disclosed in the prior art documents U.S. Pat. No. 5,177,828, U.S. Pat. No. 4,586,211 and U.S. Pat. No. 3,346,896.

The aims are attained by the characteristics of the invention reported in the independent claim. The dependent claims delineate preferred and/or particularly advantageous aspects of the invention.

DESCRIPTION OF THE INVENTION

An embodiment of the invention discloses a cleaning machine for cleaning surfaces comprising a frame, provided in proximity of a side thereof with two idle coaxial wheels for resting on a floor surface, and a maneuvering handlebar.

The frame can oscillate with respect to an axis of the wheels, acting on the handlebar.

The frame bears a rotating cleaning organ able to enter into contact with the surface to be cleaned.

During the cleaning operation the frame is rested on the wheels and on the cleaning organ.

The frame of the machine further comprises auxiliary rest means on the surface to be cleaned, located on a side of the frame opposite the wheels, able to come into contact with the surface when the frame is inclined upwards and the cleaning organ is raised.

The auxiliary rest means, in a particular embodiment of the invention, are constituted by a small pirouetting wheel located on the base of a stem, slidable internally of a bushing solidly constrained to the side of the frame opposite the side comprising the wheels.

The stem slides by the own weight thereof with respect to the bushing, with the auxiliary wheel always in contact with the floor surface.

The stem is provided on a circumference thereof with a groove following a closed pathway.

The pathway comprises a first and a second upper cusp proximal to the end of the stem that is distal from the auxiliary wheel, the first and second upper cusps being alternated between a first and a second lower cusp directed towards the end of the stem proximal to the auxiliary wheel.

The first lower cusp extends to not beyond a halfway point of the stem, while the second lower cusp extends to in proximity of the lower end of the stem.

The two sides of the cusp are respectively one inclined with respect to the axis of the stem and the other at least for the extension departing from the cusp, parallel to the axis of the stem.

The groove receives a pin solidly constrained to the bushing and, by sliding the bushing with respect to the pin, by means of the manual raising of the frame into the inclined position, the pin draws the stem in rotation by sliding in the inclined sides of the upper cusps and becoming positioned in one of the upper cusps.

By lowering the frame and with it the bushing, the pin slides to one of the lower cusps.

To guarantee the resting of the cleaning organ on the floor surface, a short straight extension branches downwards from the second lower cusp.

In this position, the pin, and with it the bushing, can oscillate slightly vertically so as to guarantee the resting of the cleaning organ on the floor surface.

The following complete raising of the frame brings the pin into the successive upper cusp and the following lowering of the frame is not impeded until the pin is in the first successive lower cusp, keeping the frame raised and with it the cleaning organ.

With this solution, a groove is formed that defines a stable and stationary position of the pin coinciding with the configuration in which the auxiliary wheel is lowered with respect to the frame and the support frame and the cleaning organ are raised with respect to the surface to be cleaned.

BRIEF DESCRIPTION OF THE DRAWINGS

The constructional and functional characteristics of the invention will emerge from a reading of the detailed description that follows, having as object a particular preferred embodiment of the invention, provided by way of non-limiting example, illustrated in the figures of the accompanying tables.

BEST WAY OF CARRYING OUT THE INVENTION

Figure 1:
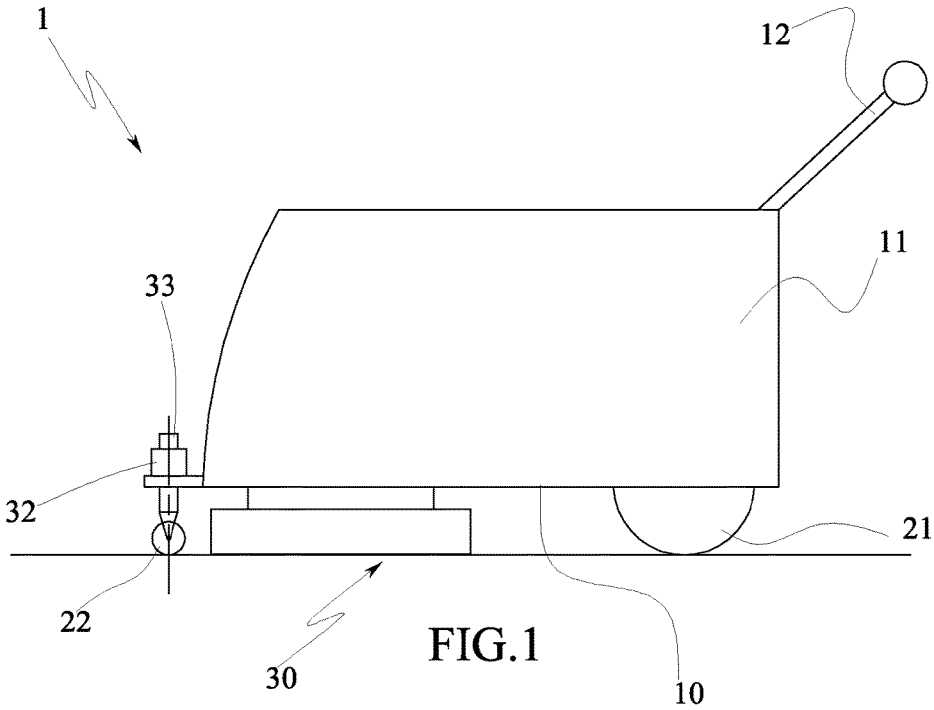
FIG. 1 is a lateral view of the cleaning machine in the cleaning configuration.
Figure 2:
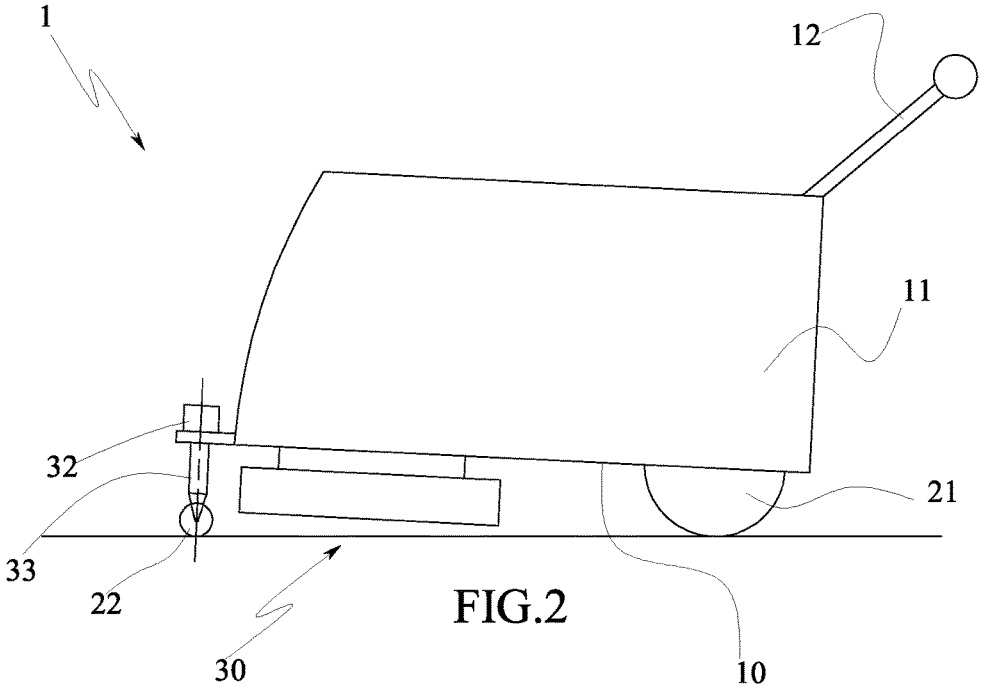
FIG. 2 is a lateral view of the cleaning machine in the maneuvering configuration.
Figure 4:
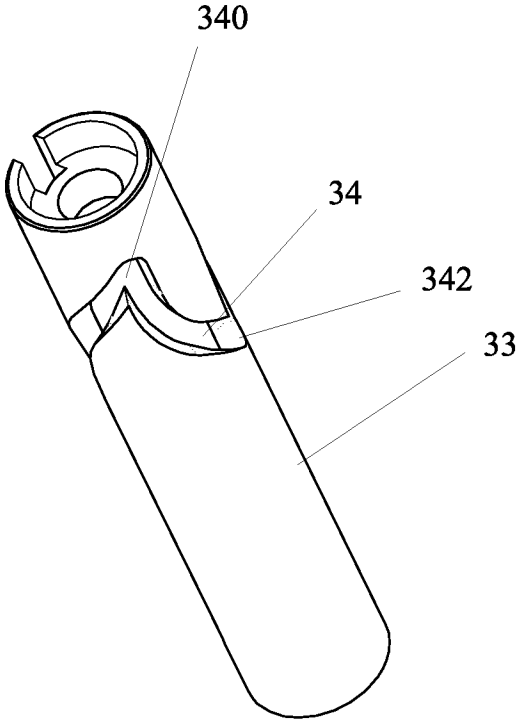
FIG. 4 is an axonometric view of the stem.
Figure 3:
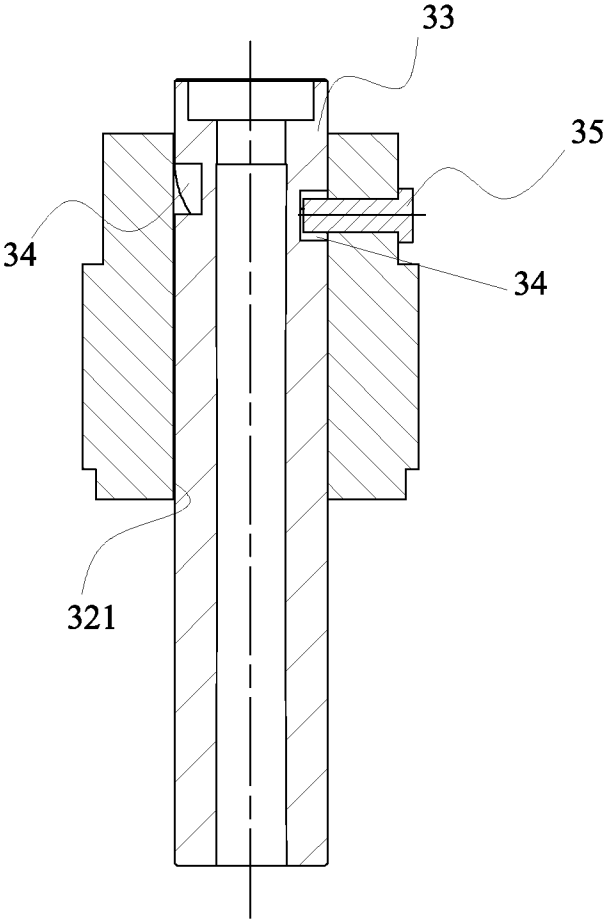
FIG. 3 is a section of the auxiliary rest organ in a plan view of the drawing of FIG. 2.

With particular reference to the figures, 1 denotes in its entirety a cleaning machine for surfaces, such as for example floors.

The cleaning machine 1 comprises a support frame 10 movable on the surface.

The support frame 10 rests on the floor by means of a pair of rear wheels 21, and is provided with a maneuvering handlebar 12 associated to the support frame 10 substantially at the longitudinal end of the support frame 10 proximal to the rear wheels 21.

The cleaning machine 1 further comprises at least a rotary cleaning organ 30 associated to the support frame 10 and able to enter into contact with the surface to be cleaned.

The support frame 10 bears a motor, for example electric, for activating in rotation the cleaning organ 30, the batteries for supplying the motor and a tank for any cleaning water present, possibly mixed with appropriate detergents.

The frame 10 is covered by bodywork 11.

In particular the rear wheels 21 are flanked to one another in a coaxial an and are associated idle to the support frame 10 substantially at the longitudinal end of the support frame from which the maneuvering handlebar 12 branches.

The support frame 10 comprises, at the front longitudinal end thereof, opposite the end proximal to the wheels 21, an auxiliary rest organ provided with an auxiliary rest wheel 22, associated to the support frame 10.

The auxiliary rest wheel 22 is, for example of the pirouetting type and it is, for example, smaller than the rear wheels 21.

The auxiliary rest wheel 22 is located at a bottom of a stem 33.

In the embodiment shown in the figures the cleaning organ 30 is a rotary brush having a substantially circular shape and fixed to the lower part of the support frame 10 facing towards the surface to be cleaned.

In particular the cleaning organ 30 can rotate about a substantially perpendicular axis to the surface to be cleaned.

The cleaning organ 30 can be of any shape without forsaking the inventive concept of the present invention, for example the cleaning organ 30 could be a cylindrical brush able to rotate about an axis that is substantially parallel to the surface to be cleaned.

The cleaning machine 1 might comprise a plurality of cleaning elements 30.

The auxiliary resting organ associated to the support frame 10 enables selective passage between a cleaning configuration in which the rotary cleaning organ 30 is placed in contact with the surface to be cleaned and a maneuvering configuration in which the cleaning organ 30 is raised at a distance from the surface to be cleaned.

In the preferred embodiment illustrated in the figures, the auxiliary rest organ comprises a bushing 32 having a hollow cylindrical shape and open at the ends, which is associated to the support frame 10, and a stem 33 inserted in the bushing 32 and fixed to the auxiliary rest wheel 22.

The stem 33 is freely slidable in the bushing 32.

A through-hole 321 is realised on the lateral wall of the bushing 32, substantially perpendicular to the longitudinal axis of the bushing.

The through-hole 321 is able to house a pin 35.

In particular the pin 35 is substantially cylindrical and is fixed to the through-hole 321 of the bushing 32 in such a way as to project internally of the bushing 32.

The through-hole 321 and the pin 35 can be threaded in such a way as to enable the pin 35 to be calibrated, i.e. to define the length of the pin 35 projecting internally of the bushing 32.

The stem 33 is substantially cylindrical and bears at the base thereof the auxiliary rest wheel 22 resting on the surface to be cleaned.

Figure 5:
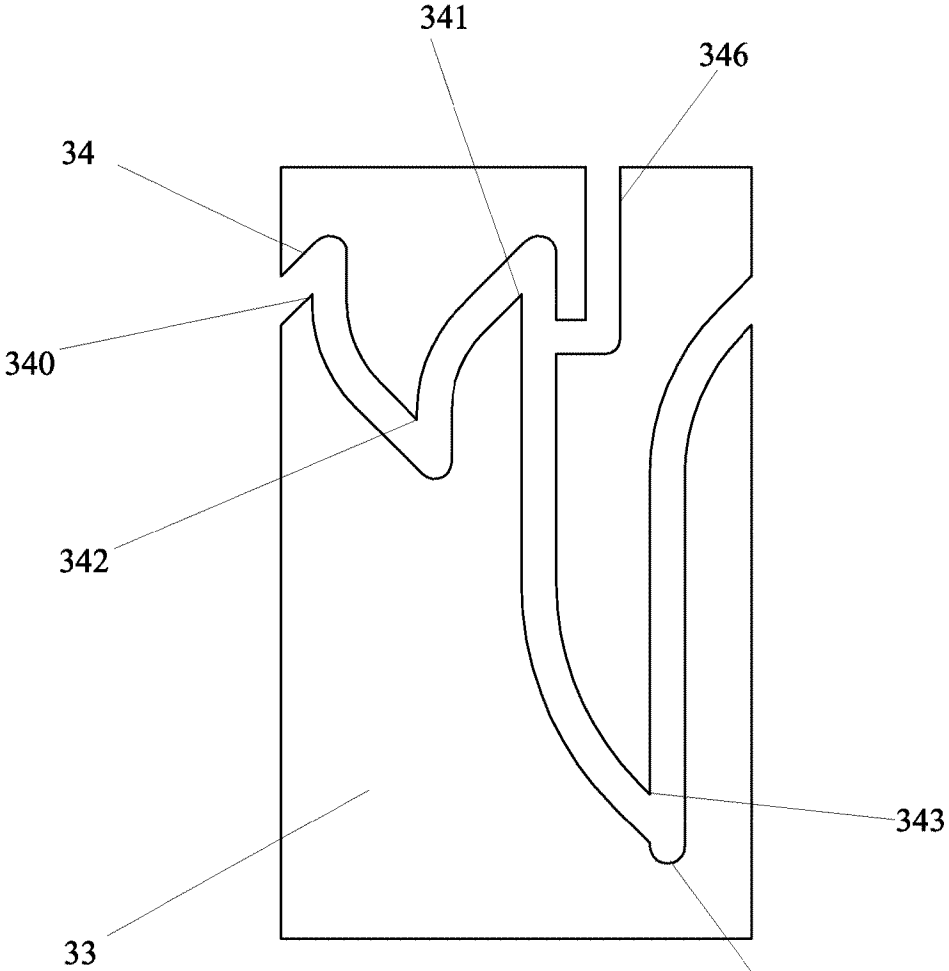
FIG. 5 is a plan-view development of the cylindrical surface of the stem.

A groove 34 is realized on the lateral surface of the stem 33 (FIG. 5) able to guide the bushing 32 between the lowered position and the raised position, as will more fully emerge in the following.

The groove 34 can slidingly house the pin 35 associated to the bushing 32.

The groove 34 defines a closed pathway on the lateral surface of the stem 33.

The pathway of the groove 34 comprises a first 340 and a second 341 upper cusp alternated with a first 342 and a second lower cusp 343.

The raising of the bushing 32, which occurs when raising the end of the support frame 10, causes translation of the pin 35 from a lower cusp, for example from the first lower cusp 342, to the successive upper cusp, for example to the second upper cusp 341, while the lowering of the bushing 32 causes translation of the pin 35 from an upper cusp, for example the second upper cusp 341, to the successive lower cusp, for example to the second lower cusp 343.

The first 340 and the second 341 upper cusp are proximal to the end of the stem 33 distal from the auxiliary rest wheel 22, and are alternated with the first 342 and the second 343 lower cusp directed towards the end of the stem 33 proximal to the auxiliary rest wheel 22.

The first lower cusp 342 extends not beyond halfway down the stem 33, while the second lower cusp 343 extends to in proximity of the lower end of the stem 33.

At the second lower cusp 343, the groove 34 extends downwards in a brief vertical portion 344.

The two sides of the upper cusps 340, 341 and the lower cusps 342, 343 are respectively one inclined with respect to the axis of the stem 33 and the other, at least for the portion starting from the respective cusp 340, 341, 342, 343, parallel to the axis of the stem 33.

The groove 34 receives the pin 35 solidly constrained to the bushing 32, and by causing the bushing 32 to slide axially with respect to the pin 35, by means of the manual raising and lowering of the support frame 10, the pin 35 draws the stem 33 in rotation by sliding in the sides of the cusps 340, 341, 342, 343.

By lowering the support frame 10, and therefore the bushing 32, the pin 35 becomes positioned in the first lower cusp 342 of the groove 34 of the stem 33, and the support frame 10 is raised from the surface to be cleaned, rested frontally on the auxiliary rest wheel 22.

When raising the support frame 10 and therefore the bushing 32, the pin 35 slides on the inclined side connecting the first lower cusp 342 to the second upper cusp 341, and then when lowering the bushing 32 the pin 35 slides to the second lower cusp 343 and to the successive vertical portion 344, causing the resting of the cleaning organ 30 on the floor surface.

The groove 34 comprises an inserting portion 346 of the pin 35 enabling the inserting and extracting of the pin 35 in the groove.

In particular, the inserting portion 346 is substantially L-shaped and comprises a first portion open at a longitudinal end of the stem 33 and substantially parallel to the longitudinal axis of the stem 33, and a second portion substantially perpendicular to the longitudinal axis of the stem 33, for access to the inclined side of the first upper cusp 340.

The functioning of the cleaning machine 1 as described above is as follows.

The cleaning machine 1 is initially, for example, parked in a suitable parking station in the maneuvering condition, i.e. the support frame 10 is inclined and the cleaning organ 30 is raised at a distance from the surface to be cleaned.

Further, in this maneuvering configuration the pin 35 is rested in the first lower cusp 342.

The operator activates the cleaning machine 1 by pushing it, by means of the maneuvering handlebar 12, from the parking station to the surface to be cleaned; this operation is facilitated by the lack of contact between the cleaning organ and the surface to be cleaned.

To begin the cleaning operation the cleaning machine 1 must pass from the maneuvering configuration to the cleaning configuration by actuating the pin 35 from the first lower cusp 342 to the second upper cusp 341, inclining the support frame 10 and causing the bushing 32 to rise upwards.

The pin 35 rises and slides in the groove 34, causing the rotation of the stem 33 about the longitudinal axis thereof, internally of the bushing 32.

When the pin 35 is in the second upper cusp 341 the support frame 10 is lowered onto the surface to be cleaned and the cleaning organ 30 is placed in contact with the surface to be cleaned; the cleaning machine 1 is then in the cleaning configuration.

In the embodiment shown in the figures, when the cleaning machine 1 is in the cleaning configuration, the pin 35 is proximal to the second lower cusp 343, in the vertical portion of the side thereof or in the underlying vertical portion 344.

When the surface has been cleaned, to return the cleaning machine 1 to the parking station the raising and lowering action of the frame and the bushing 32 is repeated, thus returning the pin 35 to rest in the first lower cusp 342, so that the cleaning machine 1 is newly in the maneuvering configuration.

The invention as it is conceived is susceptible to numerous modifications and variants, all falling within the scope of the inventive concept.

Further, all the details can be replaced by other technically-equivalent elements.

In practice, the materials used, as well as the contingent shapes and dimensions, can be any according to requirements, without forsaking the scope of protection of the following claims.

The invention claimed is:

1. A cleaning machine (1) for cleaning surfaces, comprising:

a support frame (10), at least a rotary cleaning organ (30) associated to the support frame (10) and able to enter into contact with the surface to be cleaned, first rest wheels (21) of the support frame (10), an auxiliary rest wheel (22) of the support frame (10) that can assume a first position in which the wheel (22) is raised with respect to the support frame (10) and a second position in which the wheel (22) is lowered with respect to the support frame (10), wherein the auxiliary wheel (22) is positioned at a base of a stem (33) slidable in a bushing (32) associated to the support frame (10) with the axis perpendicular to the frame between a first raised position and a second lowered position, wherein the stem (32) comprises a groove (34) defined on a surface thereof and the bushing (32) comprises a pin (35) projecting internally of the bushing (32) and able to slide in the groove (34), wherein the groove (34) comprises a first (340) upper cusp and a second (341) upper cusp proximal to the end of the stem (33) that is distal from the auxiliary rest wheel (22), and a first (342) and a second (343) lower cusp directed towards the end of the stem (33) proximal to the auxiliary rest wheel (22), wherein the first and second upper cusp (340, 341) is alternated between the first (342) lower cusp and the second (343) lower cusp directed towards the end of the stem (33) proximal to the auxiliary rest wheel (22), wherein the first lower cusp (343) extends to not beyond a median point of the stem (33), while the second lower cusp (343) extends to in proximity of the lower end of the stem (33).

2. The cleaning machine of claim 1, wherein the first lower cusp (342) defines a seating of the pin (34) associated to the bushing (32), in which the pin and the bushing rest stably in the raised position of the bushing (32), of the support frame (10) and of the cleaning organ (30).

3. The cleaning machine of claim 1, wherein, at the second lower cusp (343) the groove (34) extends vertically for a vertical portion (344) in a downwards direction.

* * * * *